US005263460A

United States Patent [19]

Baxter et al.

[11] Patent Number: 5,263,460

[45] Date of Patent: Nov. 23, 1993

[54] DUTY CYCLE PURGE CONTROL SYSTEM

[75] Inventors: Claude J. Baxter, Utica; William B. Blomquist, Clarkston; Cynthia H. Cichon, Milford; Roland T. Richardson, Detroit, all of Mich.

[73] Assignee: Chrysler Corporation, Highland Park, Mich.

[21] Appl. No.: 876,664

[22] Filed: Apr. 30, 1992

[51] Int. Cl.[5] ..... F62M 29/00

[52] U.S. Cl. ..... 123/520; 123/458

[58] Field of Search ..... 123/458, 516, 518, 519, 123/520, 521

[56] References Cited

U.S. PATENT DOCUMENTS

| | | | |
|---|---|---|---|
| 4,658,797 | 4/1987 | Brand | 123/458 |
| 4,683,861 | 8/1987 | Breitkreuz et al. | 123/458 |
| 4,821,701 | 4/1989 | Nankee, II et al. | 123/520 |
| 4,865,000 | 9/1989 | Yajima | 123/458 |
| 5,054,455 | 10/1991 | Cook | 123/520 |
| 5,060,621 | 10/1991 | Cook et al. | 123/520 |
| 5,067,469 | 11/1991 | Hamburg | 123/520 |
| 5,080,078 | 1/1992 | Hamburg | 123/521 |
| 5,103,794 | 4/1992 | Shiraishi | 123/520 |
| 5,143,040 | 9/1992 | Okawa et al. | 123/520 |
| 5,150,686 | 9/1992 | Okawa et al. | 123/520 |

*Primary Examiner*—Willis R. Wolfe
*Assistant Examiner*—Thomas N. Morris
*Attorney, Agent, or Firm*—Mark P. Calcaterra

[57] ABSTRACT

A method of controlling a purge solenoid for a purge control system of an internal combustion engine is provided. The method includes the steps of determining whether predetermined conditions are right for duty cycling the purge solenoid and turning the purge solenoid OFF if predetermined conditions are not right and obtaining a duty cycle for the purge solenoid based on a duty cycle flow (DCFLOW) if predetermined conditions are right. The method also includes the steps of determining an output level of the purge solenoid based on the obtained duty cycle and controlling the purge solenoid to the obtained duty cycle.

17 Claims, 3 Drawing Sheets

DUTY CYCLE PURGE CONTROL SYSTEM

BACKGROUND OF THE INVENTION

1. Field of the Invention

The present invention relates generally to a control system for an internal combustion engine, and more particularly to, a method of controlling a purge solenoid for a control system of an internal combustion engine.

2. Description of the Related Art

Under normal operating conditions, fuel vapors form inside an automotive vehicle's fuel tank. These vapors are temporarily stored inside of a vapor storage canister. These containment devices are also known as purge canisters, vapor canisters, and the like. A typical purge canister contains a quantity of activated charcoal as the preferred medium for storing the fuel vapors. Because the purge canister's storage capacity is limited by the charcoal becoming saturated with absorbed fuel vapor, it is necessary to purge the canister with fresh air to remove the fuel vapor.

Typically, a control system is used to purge the canister. The control system includes a purge solenoid which is turned ON and OFF to control fuel vapor purged from the purge canister. An example of such a control system is disclosed in U.S. Pat. No. 4,821,701 to Nankee II et al., the disclosure of which is hereby incorporated by reference. Although this control system has worked well, there is still a need to control and vary the amount of purge flow from the purge canister to the internal combustion engine.

SUMMARY OF THE INVENTION

It is, therefore, one object of the present invention to provide a method of controlling purge flow to an internal combustion engine.

It is another object of the present invention to provide a method of varying the amount of purge flow to the internal combustion engine.

It is yet another object of the present invention to duty cycle the purge solenoid to control fuel vapor purged from the purge canister.

It is a further object of the present invention to vary the duty cycle of the purge solenoid to control fuel vapor purged from the purge canister.

To achieve the foregoing objects, the present invention is a method of controlling a purge solenoid for a purge control system of an internal combustion engine. The method includes the steps of determining whether predetermined conditions are right for duty cycling the purge solenoid and turning the purge solenoid OFF if predetermined conditions are not right and obtaining a duty cycle for the purge solenoid based on a duty cycle flow (DCFLOW) if predetermined conditions are right. The method also includes the steps of determining an output level of the purge solenoid based on the obtained duty cycle and controlling the purge solenoid to the obtained duty cycle.

One advantage of the present invention is that a method is provided for controlling and varying the amount of purge flow to the internal combustion engine. Another advantage of the present invention is that higher purge flow rates may be delivered to the internal combustion engine. Yet another advantage of the present invention is that a method is provided for duty cycling the purge solenoid and for varying the duty cycle of the purge solenoid to control fuel vapor purged from the purge canister. Still another advantage of the present invention is that the duty cycle of the purge solenoid may be varied from 0% to 100% at 5 HZ and 10 HZ frequencies.

Other objects, features and advantages of the present invention will be readily appreciated as the same becomes better understood after reading the following description taken in conjunction with the accompanying drawings.

DESCRIPTION OF THE PREFERRED EMBODIMENT(S)

Figure 1:
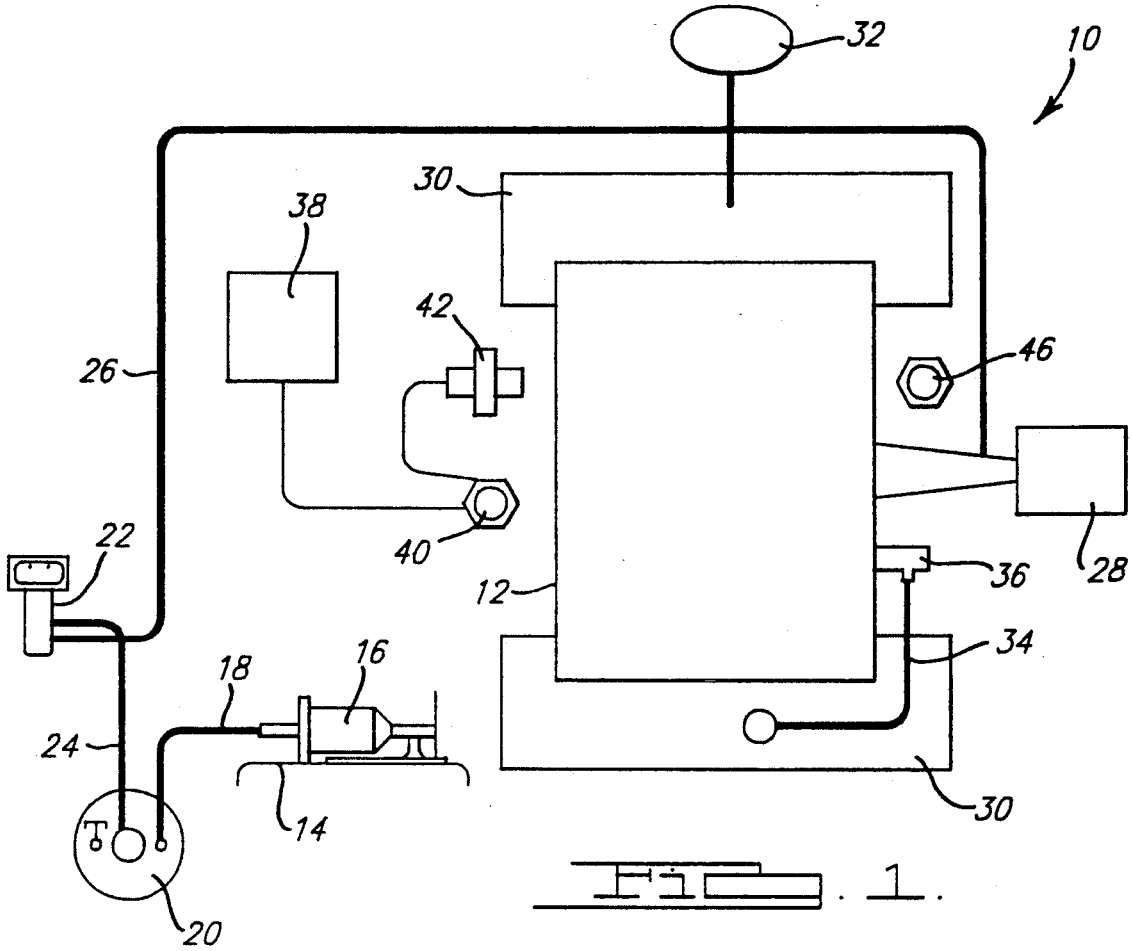
FIG. 1 is a schematic view illustrating a purge control system of an automotive vehicle in relation to various other aspects of an internal combustion engine.

Referring to FIG. 1, a fuel or purge control system 10 is shown for an internal combustion engine 12 of an automotive vehicle (not shown). The purge control system 10 includes a fuel tank assembly 14 having a pressure relief/roll-over valve 16 connected by a conduit 18 to an evaporator or purge canister 20. Under normal operating conditions, fuel vapors form in the fuel tank assembly 14 and are directed through the pressure relief/roll-over valve 16 and the conduit 18 into the purge canister 20.

The purge control system 10 also includes a purge solenoid 22 connected by a conduit 24 to the purge canister 20 and by a conduit 26 to a throttle body assembly 28. The throttle body assembly 28 is connected to the internal combustion engine 12. The internal combustion engine 12 has a pair of valve covers 30, one of which is connected to an air cleaner 32 and the other of which is connected by a conduit 34 and PCV valve 36 on a lower intake manifold (not shown).

The purge control system 10 further includes a Manifold Absolute Pressure (MAP) sensor 38 connected to an intake manifold vacuum source 40 which is connected to a fuel pressure regulator 42 on the internal combustion engine 12. The purge control system 10 also includes a backpressure EGR valve/EET assembly (not shown) connected to another intake manifold vacuum source 46 on the internal combustion engine 12. It should be appreciated that the EGR valve/EET assembly allow exhaust gas to be recirculated back into the throttle body assembly 28 to reduce exhaust emissions.

Figure 2:
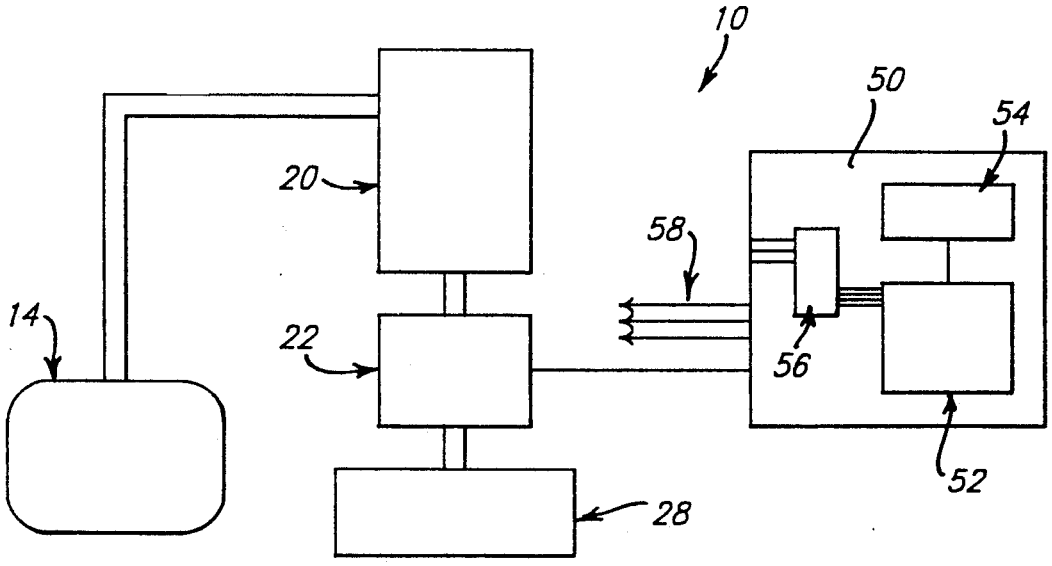
FIG. 2 is a schematic view illustrating basic components of the purge control system of FIG. 1.

Referring to FIG. 2, a schematic diagram illustrates the basic components of the purge control system 10. The purge control system 10 includes an Electronic Control Unit (ECU) 50 which controls the ON and OFF of the purge solenoid 22. The ECU 50 includes a MicroProcessing Unit (MPU) 52, memory 54, Input-/Output (I/O) module 56, (address, control and data) bus lines 58 and other hardware and software to control fuel to air ratios, fuel spark timing, EGR, and other tasks of engine control. It should be appreciated that when the ECU 50 turns ON the purge solenoid 22, fuel vapor is purged from the purge canister 20 and through the conduit 24, purge solenoid 22 and conduit 26 into the throttle body assembly 28. It should also be appreciated that the purge control system 10 may include other sensors, transducers or the like in communication with the ECU 50 to carry out the method to be described. It should further be appreciated that the purge control system 10 may operate similar to that disclosed in U.S. Pat. No. 4,821,701 to Nankee II et al., previously described.

Figure 3:
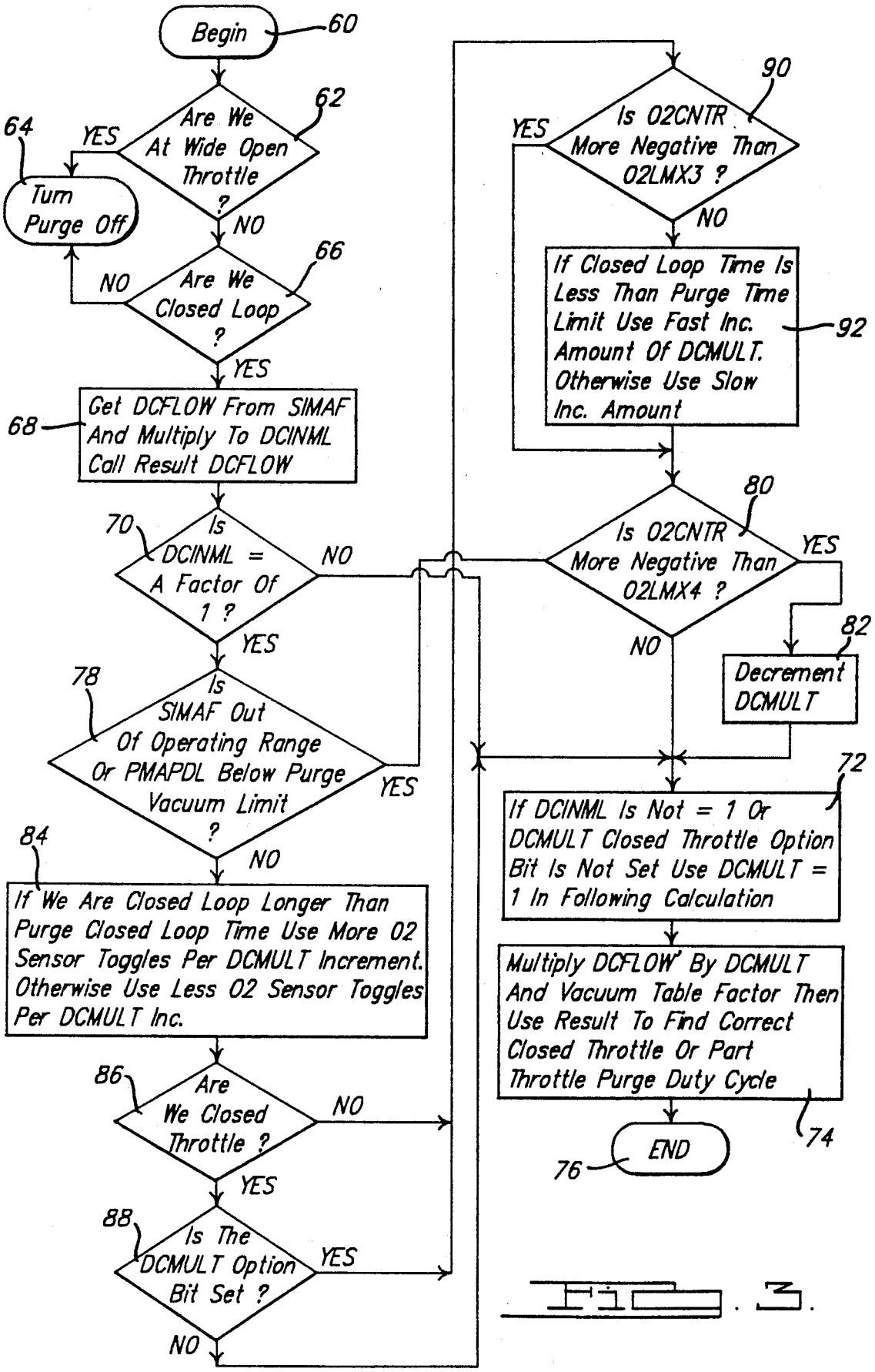
FIG. 3 is a flowchart of a method of controlling the purge control system of FIG. 1.
Figure 4:
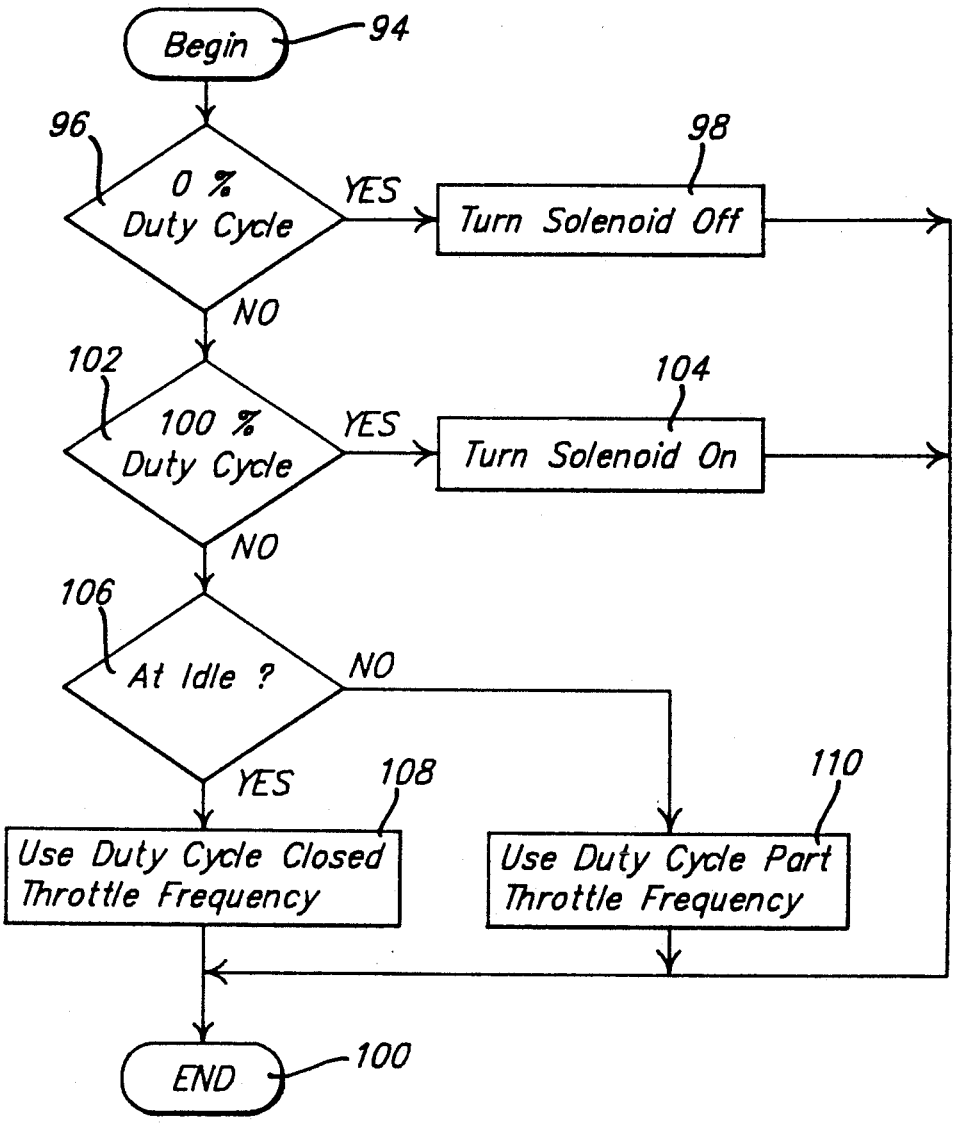
FIG. 4 is a flowchart of a method for determining an output level of the purge control system of FIG. 1.

Referring to FIG. 3, a flowchart of a method of controlling the purge solenoid 22 for the purge control system 10 is illustrated. The routine or methodology determines whether the purge solenoid 22 should be enabled (ON) or disabled (OFF). This methodology is performed after the ECU 50 calculates a Simulated Engine Airflow (SIMAF) value based on the known fuel flow through fuel injectors (not shown) at given pulse width and RPM. Once this has occurred the methodology enters at bubble 60 and advances to diamond 62. In diamond 62, the methodology determines whether the engine 12 is experiencing wide open throttle, for example, by feedback to the ECU 50 from a throttle position sensor (not shown) on the throttle body assembly 28. If so, the methodology advances to bubble 64 and turns the purge solenoid 22 OFF. If not, the methodology advances to diamond 66 and determines whether the purge control system 10 is operating in closed loop, for example, by feedback to the ECU 50 from an exhaust gas oxygen sensor (not shown) not being warmed up to a predetermined operation temperature. If the purge control system 10 is not operating in closed loop, the methodology advances to bubble 64, previously described, and turns the purge solenoid 22 OFF. If so, the methodology advances to block 68 and gets or calculates a duty cycle flow (DCFLOW) term which is equal to SIMAF, previously calculated, multiplied by a Duty Cycle Initial Multiplier (DCINML) stored in memory 54 of the ECU 50 and having a value such as 0.5.

The methodology then advances to diamond 70 and determines whether DCINML is equal to a predetermined factor or value such as one (1). If not, the methodology advances to block 72. In block 72, if DCINML is not equal to the predetermined value such as 1 or a Duty Cycle Multiplier (DCMULT) closed throttle option bit or flag to be described is not set, the methodology sets DCMULT equal to a predetermined value such as one (1). The methodology then advances to block 74 and multiplies DCFLOW, previously calculated, by DCMULT and an engine vacuum table value or factor and then uses the result to find or obtain a correct or predetermined closed throttle or part throttle purge duty cycle for the purge solenoid 22 stored in memory 54. The methodology then advances to bubble 76 and ends the routine. It should be appreciated that the engine vacuum table factor is taken from a table stored in memory 54 of engine vacuum versus duty cycle purge solenoid flow. It should also be appreciated that separate duty cycle purge solenoid flow curves for both closed throttle operation and open throttle operation are stored in memory 54.

In diamond 70, if DCINML is equal to the predetermined value such as 1, the methodology advances to diamond 78 and determines whether SIMAF is out of operating range or engine vacuum (barometric pressure minus MAP) (PMAPDL) is below a predetermined purge vacuum limit. The operating range and purge vacuum limit are predetermined values stored in memory 54. If so, the methodology advances to diamond 80 and determines whether 02CNTR is more negative than an 02CNTR limit beyond which DCMULT is allowed to decrement (02LM×4). The 02CNTR is a value based on feedback from an oxygen ($O_2$) sensor and 02LM×4 is a predetermined value stored in memory 54. If not, the methodology advances to block 72 previously described. If so, the methodology advances to block 82 and decrements DCMULT on a time basis, e.g., from 0 to 2.81 seconds per increment. If the 02CNTR is not more negative than 02LM×4 or block 82 is completed, the methodology then advances to block 72 previously described.

In diamond 78, if SIMAF is not out of operating range or PMAPDL is not below the purge vacuum limit, the methodology advances to block 84. In block 84, if the engine 12 has been operating in closed loop longer than purged closed loop time, the methodology used more 02 sensor toggles per DCMULT increment; otherwise, the methodology uses less 02 sensor per DCMULT increment. In other words, the ECU 50 has a timer (not shown) for tracking purge activity at the beginning of the methodology once the engine 12 has been operating in closed loop called "purged closed loop time". The ECU 50 receives a number of toggles or cycles from the $O_2$ sensor. As a result, the incremental rate would be faster by using fewer $O_2$ toggles between updates and the incremental rate would be slower by using a greater number of $O_2$ toggles after the timer expires.

From block 84, the methodology advances to diamond 86 and determines whether the throttle is closed, for example, by feedback from the throttle position sensor. If so, the methodology advances to diamond 88 and determines whether the DCMULT closed throttle option bit or flag is set. The DCMULT closed throttle option bit or flag provides flexibility of limiting the purge delivery at engine idle. If not, the methodology advances to block 72 previously described. If the DCMULT closed throttle option bit or flag is set, DCMULT will be active such that DCMULT will be a factor of one (1) at closed throttle and the current value of DCMULT will be used at part throttle.

If the throttle is not closed in diamond 86 or the DCMULT closed throttle option bit or flag is set in diamond 88, the methodology advances to diamond 90 and determines whether the 02CNTR is more negative than a 02CNTR limit beyond which DCMULT no longer steps (02LM×3). The 02LM×3 is a predetermined value stored in memory 54. If so, the methodology advances to diamond 80 previously described. If not, the methodology advances to block 92. In block 92, if the closed loop time is less than the purged closed loop time, the methodology uses a fast increment amount of DCMULT; otherwise, the methodology uses a slow increment amount of DCMULT. The methodology then advances to diamond 80 previously described.

Referring to FIG. 5, a methodology is illustrated for determining the output level of the purge solenoid 22 for the purge control system 10. This methodology is performed only after the purge solenoid 22 has been turned OFF by the ECU 50 in bubble 64 or the duty cycle has been obtained by the ECU 50 in block 74 of FIG. 3. The methodology begins in bubble 94 and advances to diamond 96. In diamond 96, the methodology determines whether the duty cycle of the purge solenoid 22 found in block 74 is close to or about zero percent (0%). If so, the methodology advances to block 98 and turns the purge solenoid 22 OFF. The methodology then advances to bubble 100 and ends the routine.

In diamond 96, if the duty cycle is not close to or about 0%, the methodology advances to diamond 102 and determines whether the duty cycle of the purge solenoid 22 found in block 74 is close to or about one hundred percent (100%). If so, the methodology advances to block 104 and turns the purge solenoid 22 ON. The methodology then advances to bubble 100 previously described.

In diamond 102, if the duty cycle of the purge solenoid 22 is not close to or about 100%, the methodology advances to diamond 106 and determines whether the internal combustion engine 12 is at idle, for example, by feedback from the throttle position sensor. If so, the methodology advances to block 108 and uses the duty cycle found in block 74 at the closed throttle frequency (5 Hz) to turn the purge solenoid 22 ON and OFF. The methodology controls the purge solenoid 22 to the desired or predetermined duty cycle at closed throttle found in block 74. The methodology advances to bubble 100 previously described.

In diamond 106 if the internal combustion engine 12 is not at idle, the methodology advances to block 110 and uses the duty cycle found in block 74 at the part throttle frequency (10 Hz) to turn the purge solenoid 22 ON and OFF. The methodology controls the purge solenoid 22 to the desired or predetermined duty cycle at part throttle found in block 74. The methodology then advances to bubble 100 previously described. It should be appreciated that the closed throttle and part throttle frequencies may have different values than that specified.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of controlling a purge solenoid for a purge control system of an internal combustion, said method comprising the steps of:

determining whether predetermined conditions are right for duty cycling the purge solenoid;

turning the purge solenoid OFF if predetermined conditions are not right for duty cycling the purge solenoid;

obtaining a duty cycle for the purge solenoid based on a duty cycle flow (DCFLOW) if predetermined conditions are right for duty cycling the purge solenoid;

determining an output level of the purge solenoid based on the obtained duty cycle of the purge solenoid; and controlling the purge solenoid to the obtained duty cycle.

2. A method as set forth in claim 1 wherein said step of determining an output level comprises:

determining whether the obtained duty cycle is approximately a predetermined minimum level; and turning the purge solenoid OFF if the obtained duty cycle is about the predetermined minimum level.

3. A method as set forth in claim 1 wherein said step of determining an output level comprises:

determining whether the obtained duty cycle is approximately a predetermined maximum level; and turning the purge solenoid ON if the obtained duty cycle is approximately the predetermined maximum level.

4. A method as set forth in claim 1 wherein said step of determining an output level comprises:

determining whether the internal combustion engine is operating at an idle condition; and using the obtained duty cycle at a first predetermined frequency to control the purge solenoid if the internal combustion engine is operating at an idle condition.

5. A method as set forth in claim 1 wherein said step of determining an output level comprises:

determining whether the internal combustion engine is operating at an idle condition; and using the obtained duty cycle at a second predetermined frequency to control the purge solenoid if the internal combustion engine is not operating at an idle condition.

6. A method of controlling a purge solenoid for a purge control system of an internal combustion engine, said method comprising the steps of:

determining whether predetermined conditions are right for duty cycling the purge solenoid;

turning the purge solenoid OFF if predetermined conditions are not right for duty cycling the purge solenoid;

obtaining a duty cycle for the purge solenoid based on a duty cycle flow (DCFLOW) if predetermined conditions are right for duty cycling the purge solenoid;

determining whether the obtained duty cycle is about a predetermined minimum level;

turning the purge solenoid OFF if the obtained duty cycle is about the predetermined minimum level;

determining whether the obtained duty cycle is about a predetermined maximum level if the obtained duty cycle is not about the predetermined minimum level;

turning the purge solenoid ON if the obtained duty cycle is about the predetermined maximum level;

determining whether the internal combustion engine is operating at an idle condition;

using the obtained duty cycle at a first predetermined frequency to control the purge solenoid if the internal combustion engine is operating at an idle condition; and using the obtained duty cycle at a second predetermined frequency to control the purge solenoid if the internal combustion engine is not at idle.

7. A method as set forth in claim 1 wherein said step of determining whether predetermined conditions are right comprises:

determining whether the internal combustion engine is operating at wide open throttle; and determining whether the internal combustion engine is operating in closed loop.

8. A method of controlling a purge solenoid for a purge control system of an internal combustion engine, said method comprising the steps of:

calculating the duty cycle flow (DCFLOW) based on a simulated engine airflow and a duty cycle initial multiplier (DCINML);

determining whether DCINML is equal to a predetermined value;

multiplying the calculated DCFLOW by at least one predetermined factor to find a result if DCINML is not equal to the predetermined value;

using the result to obtain the duty cycle for the purge solenoid;

determining an output level of the purge solenoid based on the obtained duty cycle of the purge solenoid; and controlling the purge solenoid to the obtained duty cycle.

9. A method of controlling a purge solenoid for a purge control system of an internal combustion engine, said method comprising the steps of;

determining whether a simulated air flow is outside of a predetermined operating range or engine vacuum is below a predetermined limit;

determining an 02CNTR value based on feedback from an oxygen sensor;

determining whether 02CNTR is more negative that a first predetermined limit if the simulated air flow is outside of the predetermined operating range or engine vacuum is below the predetermined limit;

decrementing a duty cycle multiplier factor (DCMULT) if 02CNTR is more negative than the first predetermined limit;

multiplying the calculated DCFLOW by at least one predetermined factor to find a result if DCINML is not equal to the predetermined value;

using the result to obtain the duty cycle for the purge solenoid;

determining an output level of the purge solenoid based on the obtained cycle of the purge solenoid; and controlling the purge solenoid to the obtained duty cycle.

10. A method as set forth in claim 1 wherein said step of determining whether predetermined conditions are right comprises:

determining whether 02CNTR is more negative than a second predetermined limit;

determining whether the engine is operating in closed loop longer than a predetermined time limit;

using more 02 sensor toggles per DCMULT increment if the engine is operating in closed loop expiration of the predetermined time limit; and using less 02 sensor toggles per DCMULT increment if the engine is operating in closed loop after expiration of the predetermined time limit.

11. A method of controlling a purge solenoid for a purge control system of an internal combustion engine, said method comprising the steps of:

determining whether the internal combustion engine is operating at wide open throttle;

determining whether the internal combustion engine is operating in closed loop;

calculating a duty cycle flow (DCFLOW) based on a simulated engine airflow and a duty cycle initial multiplier (DCINML)if the internal combustion engine is not operating at wide open throttle or is operating closed loop;

determining whether DCINML is equal to a predetermined value;

multiplying the calculated DCFLOW by at least one predetermined factor to find a result if DCINML is not equal to the predetermined value and using the result to obtain the predetermined duty cycle for the purge solenoid;

determining whether a simulated air flow is outside of a predetermined operating range or engine vacuum is below a predetermined limit if DCINML is equal to the predetermined value;

determining an 02CNTR value based on feedback from an oxygen sensor;

determining whether 02CNTR is more negative that a first predetermined limit if the simulated air flow is outside of the predetermined operating range or engine vacuum is below the predetermined limit;

decrementing a duty cycle multiplier factor (DCMULT) if 02CNTR is more negative than the first predetermined limit;

determining whether 02CNTR is more negative than a second predetermined limit if the simulated airflow is not outside of the predetermined operating range or engine vacuum is not below the predetermined limit;

determined whether the internal combustion engine is operating in closed loop longer than a predetermined time limit if 02CNTR is not more negative than the second predetermined limit;

sending a number of toggles from the oxygen sensor to an engine control unit;

using more oxygen Sensor toggles per DCMULT increment if the internal combustion engine is operating in closed loop;

using less oxygen sensor toggles per DCMULT increment if the internal combustion engine is operating in closed loop;

determining an output level of the purge solenoid based on the obtained duty cycle of the purge solenoid; and controlling the purge solenoid to the obtained duty cycle.

12. A method of controlling a purge solenoid for a purge control system of an internal combustion, said method comprising the steps of:

determining whether predetermined conditions are right for duty cycling the purge solenoid;

turning the purge solenoid OFF if predetermined conditions are not right for duty cycling the purge solenoid;

obtaining a predetermined duty cycle for the purge solenoid based on a duty cycle flow (DCFLOW) if predetermined conditions are right for duty cycling the purge solenoid;

determining whether the predetermined duty cycle is approximately a predetermined minimum level;

turning the purge solenoid OFF if the predetermined duty cycle is approximately a predetermined minimum level;

determining whether the predetermined duty cycle is approximately a predetermined maximum level if the predetermined duty cycle is not approximately the predetermined minimum level;

turning the purge solenoid ON if the predetermined duty cycle is approximately the predetermined maximum level;

determining whether the internal combustion engine is operating at an idle condition if the predetermined duty cycle is not approximately the predetermined maximum level;

using the predetermined duty cycle at a first predetermined frequency to control the purge solenoid if the internal combustion engine is operating at an idle condition; and using the predetermined duty cycle at a second predetermined frequency to control the purge solenoid if the internal combustion engine is not operating at an idle condition.

13. A method as set forth in claim 11 wherein said step of determining whether determined conditions are right comprises:

calculating a duty cycle flow (DCFLOW) based on a simulated engine airflow and a duty cycle internal multiplier (DCINML);

determining whether DCINML is equal to a predetermined value;

multiplying the calculated DCFLOW by at least one predetermined factor to find a result if DCINML is not equal to the predetermined value and using the result to find the predetermined duty cycle for the purge solenoid;

determining whether a simulated air flow is outside of a predetermined operating range or engine vacuum is below a predetermined limit if DCINML is equal to the predetermined value;

determining whether 02CNTR is more negative that a first predetermined limit if the simulated air flow is outside of the predetermined operating range or engine vacuum is below the predetermined limit;

decrementing a duty cycle multiplier factor (DCMULT) if 02CNTR is more negative than the first predetermined limit;

multiplying the calculated DCFLOW by at least one predetermined factor to find a result if DCINML is not equal to the predetermined value; and using result to find the predetermined duty cycle for the purge solenoid.

14. A method as set forth in claim 11 wherein said step of determining whether predetermined conditions are right comprises:

determining whether a simulated air flow is outside of a predetermined operating range or engine vacuum is below a predetermined limit;

determining whether 02CNTR is more negative that a first predetermined limit if the simulated air flow is outside of the predetermined operating range or engine vacuum is below the predetermined limit;

decrementing a duty cycle multiplier factor (DCMULT) if 02CNTR is more negative than the first predetermined limit;

multiplying the calculated DCFLOW by at least one predetermined factor to find a result if DCINML is not equal to the predetermined value and using the result to find the predetermined duty cycle for the purge solenoid;

determining whether 02CNTR is more negative than a second predetermined limit;

determining whether the engine is operating in closed loop longer than a predetermined time limit if 02CNTR is not more negative than a second predetermined limit;

using more oxygen Sensor toggles per DCMULT increment if the engine is operating in closed loop;

using less oxygen sensor toggles per DCMULT increment if the engine is operating in closed loop.

15. A method as set forth in claim 11 wherein said step of determining whether predetermined conditions are right comprises:

determining whether the internal combustion engine is operating at wide open throttle; and determining whether the internal combustion engine is operating in closed loop.

16. A method as set forth in claim 11 wherein said step of determining whether predetermined conditions are right comprises:

determining whether the internal combustion engine is operating at wide open throttle;

determining whether the internal combustion engine is operating in closed loop if the internal combustion engine is not operating at wide open throttle;

calculating a duty cycle flow (DCFLOW) based on a simulated engine airflow and a duty cycle initial multiplier (DCINML) if the internal combustion engine is operating in closed loop;

determining whether DCINML is equal to a predetermined value;

multiplying the calculated DCFLOW by at least one predetermined factor to find a result if DCINML is not equal to the predetermined value and using the result to obtain the predetermined duty cycle for the purge solenoid;

determining whether a simulated air flow is outside of a predetermined operating range or engine vacuum is below a predetermined limit if DCINML is equal to the predetermined value;

determining whether 02CNTR is more negative that a first predetermined limit if the simulated air flow is outside of the predetermined operating range or engine vacuum is below the predetermined limit;

decrementing a duty cycle multiplier factor (DCMULT) if 02CNTR is more negative than the first predetermined limit;

determining whether 02CNTR is more negative than a second predetermined limit if the simulated airflow is not outside of the predetermined operating range or engine vacuum is not below the predetermined limit;

determining whether the engine is operating in closed loop longer than a predetermined time limit if 02CNTR is not more negative than the second predetermined limit;

using more oxygen Sensor toggles per DCMULT increment if the internal combustion engine is operating in closed loop; and using less oxygen Sensor toggles per DCMULT increment if the internal combustion engine is operating in closed loop.

17. A method of controlling a purge solenoid for a purge control system of an internal combustion engine, said method comprising the steps of:

determining whether the internal combustion engine is operating at wide open throttle;

determining whether the internal combustion engine is operating in closed loop if the internal combustion engine is not operating at wide open throttle;

turning the purge solenoid OFF if the internal combustion engine is operating at wide open throttle or is not operating in closed loop;

calculating a duty cycle flow (DCFLOW) based on a simulated engine airflow and a duty cycle initial multiplier (DCINML);

determining whether DCINML is equal to a predetermined value;

multiplying the calculated DCFLOW by at least one predetermined factor to find a result of DCINML is not equal to the predetermined value and using the result to find the predetermined duty cycle for the purge solenoid;

determining whether a simulated air flow is outside of a predetermined operating range or engine vacuum is below a predetermined limit if DCINML is equal to the predetermined value;

determining an 02CNTR value based on feedback from an oxygen sensor;

determining whether 02CNTR is more negative that a first predetermined limit if the simulated air flow is outside of the predetermined operating range or engine vacuum is below the predetermined limit;

decrementing a duty cycle multiplier factor (DCMULT) if 02CNTR is more negative than the first predetermined limit;

multiplying the calculated DCFLOW by at least one predetermined factor to find a result if DCINML is not equal to the predetermined value and using the result to find the predetermined duty cycle for the purge solenoid if 02CNTR is not more negative than the first predetermined value;

determining whether the engine is operating in closed loop longer than a predetermined time limit if the simulated air flow is not outside the predetermined operating range;

sending a number of toggles from the oxygen sensor to an engine control unit;

using more oxygen Sensor toggles per DCMULT increment if the engine is operating in closed loop;

using less oxygen Sensor toggles per DCMULT increment if the engine is operating in closed loop;

determining an output level of the purge solenoid based on the predetermined duty cycle of the purge solenoid; and controlling the purge solenoid to the predetermined duty cycle.

* * * * *